US011974626B1

(12) United States Patent
LeClaire et al.

(10) Patent No.: US 11,974,626 B1
(45) Date of Patent: May 7, 2024

(54) IMPACT RESISTANT HEADGEAR

(71) Applicant: Medical Innovation Group, LLC, Vancouver, WA (US)

(72) Inventors: Jarrett LeClaire, Vancouver, WA (US); Jeffrey Charles Kelly, Downingtown, PA (US)

(73) Assignee: Medical Innovation Group, LLC, Vancouver, WA (US)

( * ) Notice: Subject to any disclaimer, the term of this patent is extended or adjusted under 35 U.S.C. 154(b) by 0 days.

(21) Appl. No.: 17/572,613

(22) Filed: Jan. 10, 2022

Related U.S. Application Data

(63) Continuation of application No. 16/365,868, filed on Mar. 27, 2019, now Pat. No. 11,219,264, which is a continuation of application No. 15/442,602, filed on Feb. 24, 2017, now abandoned.

(51) Int. Cl.
*A42B 3/12* (2006.01)
*A42B 3/04* (2006.01)
*A42B 3/06* (2006.01)

(52) U.S. Cl.
CPC ..... *A42B 3/121* (2013.01); *A42B 3/0453* (2013.01); *A42B 3/064* (2013.01); *A42B 3/067* (2013.01); *A42B 3/069* (2013.01); *A42B 3/12* (2013.01); *A42B 3/128* (2013.01); *A42B 3/063* (2013.01)

(58) Field of Classification Search
CPC ..... A42B 3/121; A42B 3/064; A42B 3/063
See application file for complete search history.

(56) References Cited

U.S. PATENT DOCUMENTS 3,529,306 A * 9/1970 Thorne ..... A47C 27/00 297/452.17
4,064,565 A * 12/1977 Griffiths ..... A42B 3/121 2/412
4,853,980 A * 8/1989 Zarotti ..... A42B 3/285 2/413
5,204,998 A * 4/1993 Liu ..... A42B 3/124 2/425
5,753,061 A * 5/1998 Rudy ..... F16F 9/0472 428/72
6,964,066 B2 * 11/2005 Tucker ..... A42B 3/12 2/418
7,082,623 B2 * 8/2006 Johnson ..... A43B 13/189 2/413
7,896,019 B2 * 3/2011 Bettin ..... A43B 13/189 137/13
8,127,373 B1 * 3/2012 Fodemski ..... A42B 3/121 2/413
8,166,574 B2 * 5/2012 Hassler ..... A42B 3/125 2/413
8,359,770 B2 * 1/2013 Frederick ..... A41D 13/015 36/28
8,850,623 B1 * 10/2014 Mazzoccoli ..... A42B 3/121 2/455
8,856,972 B2 * 10/2014 Kirshon ..... A42B 3/121 2/413

(Continued)

*Primary Examiner* — Khaled Annis
(74) *Attorney, Agent, or Firm* — Jeffrey R. Ramberg

(57) ABSTRACT

An impact reducing headgear is disclosed which utilizes dynamically responsive materials which undergo physical changes during exposure to impact forces, such that physical changes or phase changes absorb energy. The helmet may be constructed with a dual shell structure and a bladder, where the dynamically responsive materials may be contained.

21 Claims, 5 Drawing Sheets

(56) References Cited

U.S. PATENT DOCUMENTS

| | | | | |
|---|---|---|---|---|
| 8,978,167 | B2 * | 3/2015 | Blair | A42B 1/08 2/410 |
| 9,089,180 | B2 * | 7/2015 | Phipps | A42B 3/064 |
| 9,113,672 | B2 * | 8/2015 | Witcher | A42B 3/121 |
| 9,173,445 | B1 * | 11/2015 | Whitcomb | A42B 3/121 |
| 9,210,962 | B2 * | 12/2015 | Ho | A42B 3/124 |
| 9,370,216 | B2 * | 6/2016 | Brantley | A42B 3/20 |
| 9,439,468 | B1 * | 9/2016 | Blagg | A42B 3/125 |
| 9,775,396 | B1 * | 10/2017 | Olivares Velasco | G08B 13/19621 |
| 9,820,524 | B1 * | 11/2017 | Whitcomb | A63B 71/12 |
| 9,833,684 | B2 * | 12/2017 | Warmouth | A42B 3/205 |
| 9,839,250 | B2 * | 12/2017 | Nauman | A42B 3/064 |
| 9,839,251 | B2 * | 12/2017 | Pannikottu | A42B 3/121 |
| 10,426,214 | B2 * | 10/2019 | Rabinovitch | A42B 3/127 |
| 10,443,678 | B2 * | 10/2019 | Galindo Rosales | F16F 9/30 |
| 11,219,264 | B2 * | 1/2022 | LeClaire | A42B 3/12 |
| 2004/0199981 | A1 * | 10/2004 | Tucker | A42B 3/12 2/414 |
| 2007/0107778 | A1 * | 5/2007 | Bettin | F16F 9/53 137/13 |
| 2013/0000020 | A1 * | 1/2013 | Frederick | A42B 3/121 2/455 |
| 2014/0000012 | A1 * | 1/2014 | Mustapha | H01F 7/02 2/414 |
| 2015/0033453 | A1 * | 2/2015 | Pannikottu | B32B 5/18 2/413 |
| 2015/0089722 | A1 * | 4/2015 | Berry | A42B 3/064 2/412 |
| 2015/0272255 | A1 * | 10/2015 | Galaitsis | A42B 3/122 2/413 |
| 2018/0303189 | A1 * | 10/2018 | Hallander | A42B 3/128 |
| 2019/0328070 | A1 * | 10/2019 | Brachos | F41H 1/08 |

* cited by examiner

IMPACT RESISTANT HEADGEAR

BACKGROUND

Many sports, extracurricular activities, and occupations, involve contact. Various of these activities involve exposure of the head to rapid stressing, and these impact forces have been found to cause injury to the brain. Moreover, it has also been found that less traumatic, but repetitive instances of stressing the brain, causes injury over time.

More recently, scientists have studied a disease, now known as Chronic Traumatic Encephalopathy (CTE) which is being diagnosed in ex-football players. It is believed to result from the injury the brain receives when it impacts the inside of the skull; thus, the focus on diagnosis and prevention needs to consider two impacts, the initial impact to the external side of the skull, and the internal impact where the brain impacts the inside of the skull. This motion referred to as coup-contrecoup (C-C) action is a potential cause of CTE, even occurring in small or minor impacts. The brain is somewhat mobile inside the skull, as it rests in cerebrospinal fluid; it is not rigidly attached to the skull, and this feature serves to protect it well, except during instances of impact.

The C-C damage, it is believed, may occur with less injury than what has been shown to cause a typical concussion. That is, CTE may result where normal symptoms seen in a concussion (e.g., dizziness, loss of memory, vomiting, vertigo, and loss of consciousness) are not experienced; further, there may be no brain bleeding or recognized swelling. The modality of the disease appears to progressive, and triggered by impact to cause a buildup of an abnormal protein in the brain referred to as Tau.

While it is easy to understand many sports and other activities that may involve head impact, to varying degrees, the most prevalence of CTE is in ex-football players. In fact, this past March, the National Football League first publicly acknowledged a connection between football and CTE. The NFL had appointed a Doctor to a newly created position of Chief Health and Medical Advisor in 2015, perhaps among other things, to monitor this disease and the current state of the game.

Their currently is no treatment for CTE, and the only sure way to diagnose it is through an autopsy. Symptoms of CTE include nausea, disorientation, memory loss, confusion, mood swings, and depression. All of these symptoms are common to other issues, situations, or ailments, further making diagnoses more difficult. These elusive diagnoses are believed to have limited the attention to CTE over the years. Other sports are gaining visibility with participants at high levels beginning to speak out; for example, people from soccer, rugby, and boxing have recently been more vocal about symptoms and concerns. Clearly, there exists a need for protective head gear, for all ages and various sports, whether it is for protect from chronic indications such as CTE or acute conditions such as a concussion.

SUMMARY

The current invention attempts to limit C-C injury resulting from impact, by absorbing energy from said impact through constructs of energy absorbing materials or constructs of head gear geometry, as well as combinations of these approaches.

In a preferred embodiment, the head gear has a dual shell structure; wherein the dual shell structure consists of an inner shell and an outer shell with a functional gap located between the shells. The functional gap may contain a bladder which in turn may contain a dynamically responsive material or member.

The dynamically responsive materials disclosed and described herein include materials broadly classified as thixotropic, rheopectic, and dilatantic. These various embodiments contemplate materials, mixtures, and compounds recognized by those skilled in the art to exhibit properties common to these broad classes of materials; examples disclosed or described herein are not meant to be limiting.

Thixotropic materials demonstrate "thixotropy" which is a time-dependent shear thinning property. These types of materials are very thick or viscous under static conditions; but they will flow, become thin or less viscous over time when shaken, agitated, sheared or otherwise stressed. This unique feature is commonly referred to as time dependent viscosity. When the transformational stresses are released or discontinued, the materials will then return to the original more viscous state; however, this transgression does take a finite period of time.

Certain paints exhibit thixotropy, and can utilize this property to be applied more easily to their target substrate. This, the paint exists initially in a gel form; but the gel becomes very fluid as a paint brush or other applicator is inserted and agitated. The induced fluidity aids in the paint coating the applicator, but as the stresses (or energy input from the applicator agitating the gel) reside the paint returns to its gel state. This return to the original state allows the paint to remain on the applicator without dripping; again, as the applicator contacts the wall or target surface energy is again absorbed causing the thinning of the paint, which affords the material a thinning condition enabling an easy transfer to the target.

Similarly, when a helmet containing a thixotropic material encounters a rapid stressing, the gel absorbs energy while becoming more fluid. This absorption of energy is tailorable, based upon the type of thixotropic material. Additionally, various compositions could be used in concert, whether housed in a single or multiple bladders.

Interestingly, certain materials exhibit a rheopectic nature, which is fundamentally the opposite of thixotropy. That is, as stress is applied to a rheopectic material, its viscosity increases; along with the viscosity increase is the concomitant absorption of energy. Similarly with thixotropic materials, the energy absorption is not instantaneous, as some material transitions can be (especially those involving isothermal phase changes).

It is recognized that a rheopectic and a thixotropic material could be used in concert. This dual material composition could be used to tailor the "feel" of a material, as one absorbs energy so does the other, so each material could serve to dampen the effects of the other. Of course, while they would dampen the resulting effect on mechanical properties, they would both absorb energy; this dual energy absorption could result in a favorable design that absorbs more energy than a single material design.

A further modification or tailoring of properties may be made by an addition of a dilatant fluid or dilatant material. Dilatant fluids are similar to rheopectic materials, but they are different in a manner that may be very significant in this application. Dilatant fluids, while of low viscosity at an un-agitated or non-stressed state, become highly viscous nearly instantaneously; which may also be beneficial to this design on its own, or as a component of a blend or composite of materials. This fluid is a non-Newtonian fluid, just as thixotropic and rheopectic fluids are; that is, viscosity varies with stress and stress application rate. It is recognized that blending of these types of materials together, or using them separately but in concert (as in a composite construct) could positively alter the strain response profile. The profile could be influenced by not only the selection of each material, but also by the volume ratio of each type of material. It is also recognized that as the stress is being absorbed, the rate of transition in each material may be different; thus the pseudoplastic response rate could be affected by things such as, but not limited to, the response factor of the component materials.

In another preferred embodiment, the design or placement of the bladder or the dynamic responsive material renders the helmet to have properties that are oriented and cause the helmet to absorb increased energy. Such orientation may be achieved with distinctly varied dynamically responsive materials being located at strategic places or regions, which causes the helmet to move or rotate upon a phase change or other dynamic response to the impact.

In another preferred embodiment, the dual shell structure is arranged such that the outer shell is less rigid than the inner shell, such that said outer shell deflects upon impact thereby absorbing energy. In such embodiment the rigid, or less flexible inner shell, serves to protect the skull by maintaining continuous contact. The deflection of the outer shell may cause a transition in the dynamically responsive material which may be located in between the dual shells. There may be more than one dynamically responsive material, as well as other materials exhibiting preferred properties.

In another preferred embodiment, a protective head gear has a dual shell structure, having an inner shell and an outer shell, with such inner shell being separated from said outer shell by a functional gap. A dynamically responsive material may be contained in such functional gap, which may be with the aid of a bladder. An engagement member may be affixed to said inner and outer shells, wherein a compressive strain on a first side of the helmet results or is translated into a tensile strain on the opposing side of the helmet. The engagement member may be a flexible member, a columnar structural member, other member suitable to transfer stress, or it may be the dynamically responsive member itself. The deformation or deflection of the engagement member may apply stress to the dynamically responsive member, and such stress may cause a phase change or other response which absorbs energy.

In another preferred embodiment, a protective head gear has an impact measurement system. Such system comprises a pressure sensitive member which is arranged between the dual shell layers, or elsewhere if a dual shell construction is not employed. The pressure sensitive member is arranged to rupture upon experiencing a predetermined impact force; and such predetermined force is below that believed to lead to CTE.

In yet another preferred embodiment, the pressure sensitive member releases a perceptible signal upon rupturing. The pressure sensitive member may be inserted in or near the bladder, in any design using same; or said pressure sensitive member may lie outside the bladder, between such bladder and outer shell; or said pressure sensitive member may lie inside the bladder, between such bladder and an inner shell, which may assist with the emission of said signal.

A perceptive signal may arise from the release of a fluid containing dye, where the dye is contained in the bladder or other containment mechanism to avoid general release eternal to the helmet. However, in a preferred embodiment the fluid containing dye is visible from the outside of said helmet.

These various signaling embodiments may utilize a dynamically responsive member, or they may be used alone. Further, said signal may be triggered at impact forces typically believed to lead to CTE in the longer term (or slightly below such level) or concussive force levels in the near term. Additionally, several signaling members may be employed at the same time, but which are set at gradually increasing trigger values. This arrangement would yield a more quantitative indication of the amount of stress the brain has seen; as opposed to the more qualitative go no-go indication with a single signaling member.

In yet another preferred embodiment, the signaling means may constructed in the basic manner described, including for example a single or plurality of signaling agents (and with a single or a plurality of bladders or other containment methods), and it could be used in a bladder with or without dynamic responsive materials. However, the signaling device may also be arranged as a stand-alone device which may be retrofitted into existing helmets.

In another preferred embodiment, the head gear comprises a dual shell structure, having a front side and a back side, wherein said dual shell structure comprises an inner shell and an outer shell, with such inner shell being separated from said outer shell by a functional gap containing a plurality of compartments. Said plurality of compartments arranged to be create radially differentiated zones; with said zones having different materials therein which in turn have different mechanical or physical properties. The radially differentiated zones having radially differentiated properties which causes said helmet to rotate upon impact; with such rotation being around an axis approximating the vertical axis created by the direction of the wearer's spine. Other axes of rotation may be achieved (e.g., forward tilting, backward tilting, or any other axis) by creating the appropriate radial mismatch in properties.

This rotational movement should be able to capture energy, in any situation where the rotation comprises circular movement of said outer shell relative to said inner shell, thereby reducing the amount of energy available to be transmitted to the wearer's head. These embodiments should reduce energy transmitted even in an instance where the radial zone only serves to amplify natural rotation mechanics upon impact.

Dissimilar impact properties may be created with at least one zone with a more rigid response upon impact and at least one zone with a less rigid response upon impact; similarly one could employ at least one zone arranged to exhibit high elastic strain upon impact and at least one zone with low elastic strain upon impact. One skilled in the art could envision various material characteristics which render different responses; the correlating materials of construction available to render these properties are within the scope of this invention.

In another preferred embodiment, a form-fitting comfortable head gear is made with a shell structure, wherein said shell structure further comprises a functional gap, with said functional gap arranged between said shell structure and the head of the wearer of the head gear. The functional gap houses a bladder arranged to contain dynamically responsive materials creating a deformable member. The deformable member is designed to create a negative clearance with the wearer's head, such that said deformable member deforms during the insertion of the wearer's head into said head gear.

The negative clearance results in a tight fit with the wearer's head, but it is comfortable and easy to insert the wearer's head because the deformable member comprises a dynamically responsive material, wherein said dynamically responsive material is arranged to react during the stress of the insertion of said wearer's head. This reaction causes a partial relaxation of the material as the vibration and disruption allow the material to deform more easily; but the material returns to its original shape (in the bladder) and its original stiffness.

This embodiment results in a tight fit with the wearer's head, thereby enabling the design mechanics of the helmet to be active and eliminating or reducing the secondary impact of the helmet to the head on impact. While the fit may be tighter, it is comfortable, because the tightness arises from the helmet's ability to extend farther around the circumference of the head (or, for example, farther into the jaw area which is normally open and therefore providing no support or protection).

In a preferred embodiment, the negative clearance helmet may be constructed such that said bladder may be arranged to have at least a second dynamically responsive material, or a second bladder containing a second dynamically responsive material.

DETAILED DESCRIPTION

Figure 1:
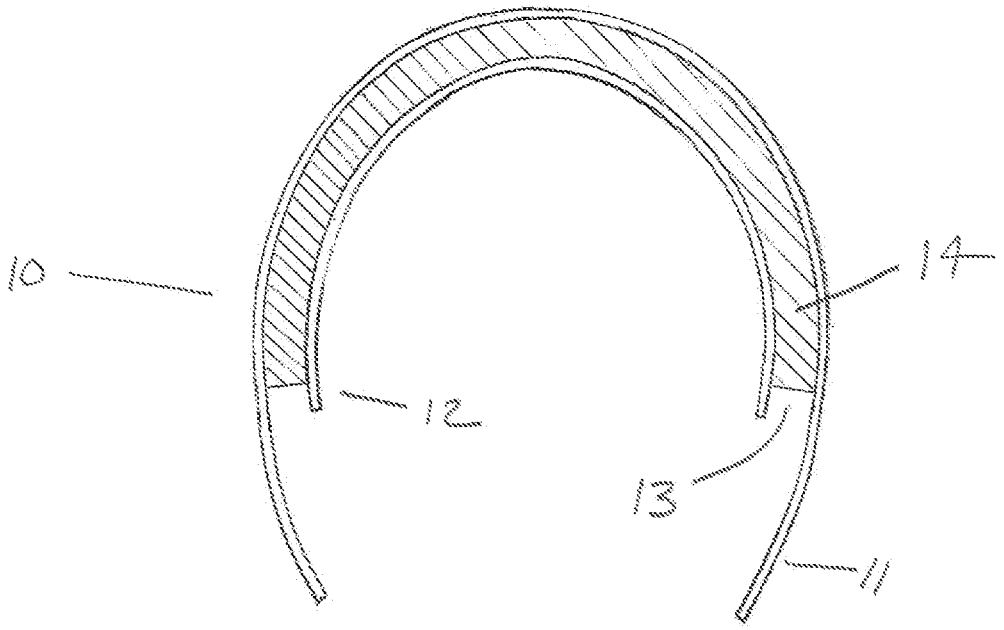
FIG. 1 is a view of a preferred embodiment of the helmet disclosed in the present invention.

Reference is made to FIG. 1 for the illustration of one preferred embodiment of an energy absorbing helmet made according to the present invention which is designated generally by the reference numeral 10. In this embodiment the helmet 10 has a dual shell structure, with an outer shell 11 being separated from an inner shell 12 by a functional gap 13. The functional gap 13 is at least partially occupied by a bladder 14.

The bladder is at least partially filled with a dynamically responsive material. The bladder may contain compartments to contain said dynamically responsive material (not shown) or bladders (not shown) within the main bladder 14. Upon impact the relative movement of the shells triggers a response from the dynamically responsive material.

In another preferred embodiment, said outer shell 12 is less rigid than inner shell 11. This will result in elastic energy being absorbed by the outer shell upon the relative deformation. Additionally, this type of embodiment could increase the stresses placed upon the bladder 14 (thereby increasing the response from the dynamically responsive material).

Figure 2:
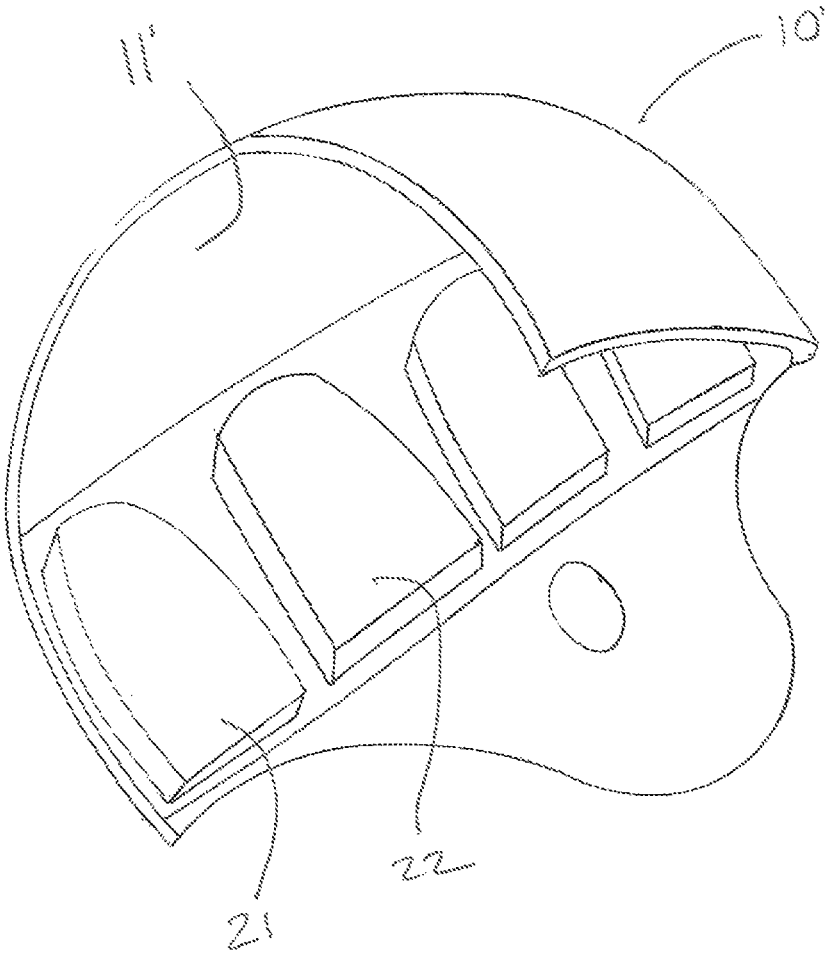
FIG. 2 is a view of another preferred embodiment disclosed.

Reference is now made to another preferred embodiment of the present invention, which is illustrated at FIG. 2. The same structures, components and features existing in this embodiment; that have been introduced in previous figures or embodiments will be represented by the same reference numeral with, however, the addition of a prime marking. In instances where this scheme may cause confusion, for example, a component in a similar location, but serving a different function, such component may be assigned a new numeric designation. This figure again shows a helmet 10' of a dual shell structure, consisting of an outer shell 11' and an inner shell (not shown). This cut-away view shows potential placement of a plurality of bladders, wherein the placement can cause oriented properties. The properties may be varied to create a rotational strain component to the relative movement of the shells (with respect to one another). For example, a highly reactive material may be placed in at least one bladder 21, while a less reactive material may be placed in a different bladder 22. The location of these bladders (that is, numbers 21 and 22) will affect the degree and direction of rotation.

In this embodiment the placement of the bladders is only meant to be illustrative, and several bladders may contain similar materials (not shown or indicated in this figure). This figure shows a design that would tend to create rotation with an axis that would approximate an axis collinear with the wearer's spine.

Additionally, the materials in the bladders may not be of high and low reactivity; they may experience an opposite type of response. For example a first bladder may contain a rheopectic material and a second bladder may contain a thixotropic material.

Figure 3:
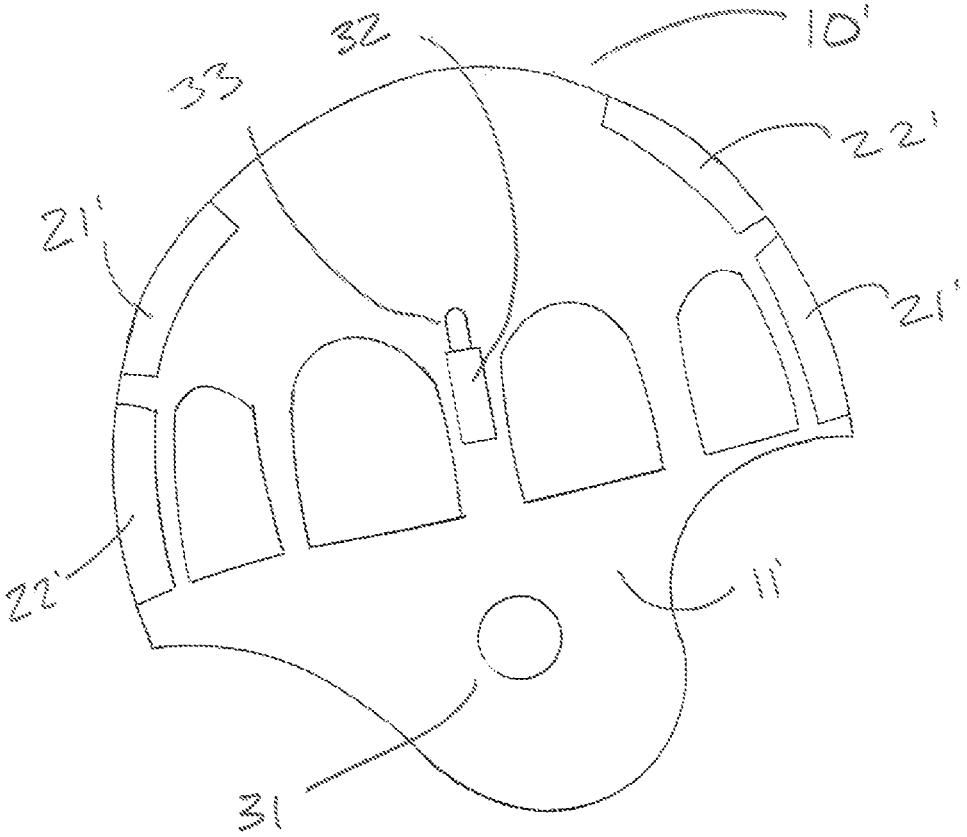
FIG. 3 is a view showing additional features which may be used with various of the preferred embodiments disclosed.

Referring now to FIG. 3, another helmet 10' embodiment is shown. This view is a half section, of a dual shell structure, consisting of an outer shell 11' and an inner shell (not shown). Similarly, this design shows a plurality of bladders, with a first set of bladders 21' having properties that vary from a second set of bladders 22.' The significance of this design is that the induced rotation upon impact would tend to be around an axis nearly approximating an axis that runs through the ear hole(s) 31 in the helmet 10.'

This figure also illustrates another embodiment that includes an impact level indicator in the form of a signaling means 32. The size, location, and orientation of the signaling means are meant for illustrative purposes only; this embodiment shows a member that may be sized to retrofit into standard helmets (not shown), and may be placed in between pads or above pads near the top of the helmet (not shown). The signaling means 32 may provide a signal that is visible from the outside of the helmet while it is being worn. For example, the signaling means 32 may be seen through a slot 33, which may be made expressly for that purpose, or it may be an air vent (not shown) in a standard helmet. The helmet 10' may have a signaling means 32 attached permanently or temporarily by, for example, and adhesive or a hook and loop type of fastener (not shown); other methods of attachment known to those skilled in the art may also be used.

Figure 4:
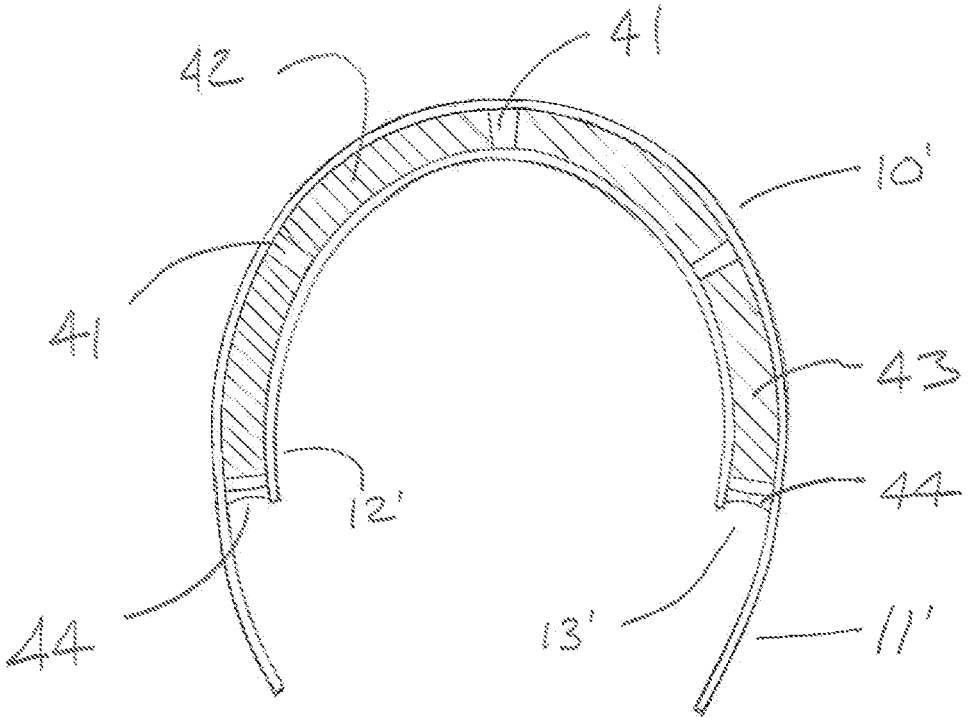
FIG. 4 is a view of yet another preferred embodiment.

Referring now to FIG. 4, another helmet 10' embodiment is shown. This view is a half section, of a dual shell structure, consisting of an outer shell 11' and an inner shell 12.' However, this figure shows different bladder configurations, and adds a structural component which allows stress to be conveyed from the outer shell 11' to the inner shell 12.' The added structural component may serve as an engagement member 41, and there may be a plurality of such members placed at various locations around the helmet (three are shown). The engagement member 41 may be arranged adjacent to, adjoining, or to serve as a constraining side of a bladder 42. In yet another embodiment the engagement member 44, is separate from, and may be placed a distance from the bladder 43.

This illustration contemplates various configurations of bladders and designed placements, it also contemplates various designs for engagement members. These examples are only meant to demonstrate the concepts and to provide examples; those skilled in the art will recognize various materials which could successfully be used as engagement members and designs for such members and bladders.

Figure 5:
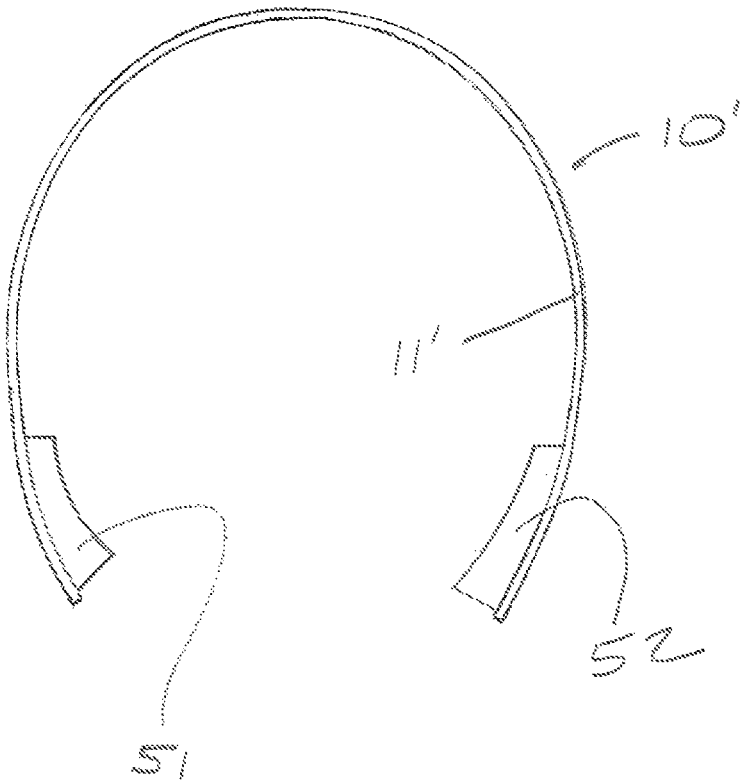
FIG. 5 is a view of the final preferred embodiment.

Referring now to FIG. 5, another helmet 10' embodiment is shown. This view is a half section, of a shell structure, consisting of an outer shell 11' and may also comprise an inner shell (not shown). This illustration shows a first deformable member 51 and a second deformable member 52. The distance between the edges forming the opening of the outer shell 11' is greater than the distance between said first deformable member 51 and second deformable member 52. This negative clearance allows for a smaller opening in helmet 10' while maintaining a tight fit with the wearer's head; where the deformable members comprise dynamically responsive materials, the jarring action of pressing the helmet onto the wearer's head could cause a transition or phase change in the materials. This reaction could render the helmet 10' easier to slide on to the head; however, once the subtle jarring or vibration type of motion ceases, the deformable member(s) would regain the stiff properties necessary for securing the helmet during impact.

In this embodiment, a thixotropic material may be used, or a combination or blend with other materials may be used, including the dynamically responsive materials disclosed herein. Furthermore, the deformable members (51 and 52) may be comprised of bladders containing the material, or of a matrix which serves to hold the material in place. In this disclosure generally, it is recognized by those skilled in the art, that various configurations or designs may be arranged to constrain, hold, or support a dynamically responsive material; this disclosure and these figures are not meant to be limiting in that regard.

The deformable members may be used along edges of the helmet 10,' whether arranged to be affixed to the outer shell 11' or an inner shell 12' (where such inner shell is employed); with such placement being at the opening region which is more forward facing, or the opening region which is more downward facing (not shown). These designs which provide more support to the facial area and the lower skull region, respectively; while maintaining a level of comfort and ease of head insertion.

While this disclosure refers to general illustrative embodiments as well as various particular embodiments, it should be understood that the disclosure is not limited thereto. Modifications can be made to the embodiments described herein without departing from the spirit and scope of the present disclosure, even where certain modifications are suggested, this disclosure is not necessarily exhaustive. Those skilled in the art with access to this disclosure will recognize additional modifications, embodiments, and methods of use within the scope of this disclosure; and similarly, additional fields of use in which the disclosed invention could be applied may be contemplated. Therefore, this detailed description is not meant to be limiting. Further, it is understood that the apparatus and methods described herein can be implemented in many different embodiments of hardware, devices, or systems. Any actual apparatus, method of manufacture, or method of use, described is not meant to be limiting. The operation and behavior of the apparatus and methods presented are described with the understanding that modifications and variations of the embodiments as well as modalities of use and operation are possible.

The invention claimed is:

1. A tight fitting comfortable head gear configured to fit a head of a wearer, comprising:

A shell structure, wherein said shell structure further comprises an inner shell and an outer shell, further defining a functional gap, with said functional gap arranged between said outer shell structure and said inner shell, said shell structure further defining at least a forward-facing opening and a downward-facing opening;

at least one bladder arranged to contain therein at least one dynamically responsive material, wherein said bladder comprises at least one compartment and is disposed in said functional gap;

wherein in a half sectional view, said at least one bladder and dynamically responsive material appears as a first deformable member and a second deformable member, said first deformable member and second deformable member creating negative clearance with respect to the wearer's head such that said first deformable member and second deformable member deforms during insertion of the wearer's head into said head gear, and further wherein a distance across said downward-facing opening at a lower edge is greater than a distance from said first deformable member to said second deformable member, wherein during the insertion of the wearer's head into said head gear, said dynamically responsive material becomes more fluid as a result of forces and vibration associated with said insertion, thereby permitting said dynamically responsive material to deform.

2. The head gear of claim 1, wherein said dynamically responsive material is further arranged to exhibit thixotropic properties.

3. The head gear of claim 1, wherein said dynamically responsive material is further arranged to be located near the opening in said head gear.

4. The head gear of claim 1, wherein said wherein said tight fit causes said inner shell to directly engage with the wearer's head to allow more effective impact.

5. The head gear of claim 1, wherein said tight fit causes said head gear to directly engage with the wearer's head to allow more effective impact resistance.

6. The head gear of claim 1, wherein said bladder is arranged to have at least a second dynamically responsive material.

7. The head gear of claim 6, wherein said second dynamically responsive material comprises rheopectic material.

8. The head gear of claim 6, wherein said second dynamically responsive material comprises a combination of a thixotropic and a rheopectic material.

9. The head gear of claim 6, wherein said second dynamically responsive material comprises thixotropic material.

10. A tight fitting comfortable head gear configured to fit a head of a wearer of the head gear, comprising:

A shell structure, wherein said shell structure further comprises a functional gap, with said functional gap arranged between an outer shell and an inner shell, said shell structure defining at least a forward-facing opening and a downward-facing opening;

at least one bladder comprising at least one rigid dynamically responsive material, said bladder having a shell side and a wearer's side, said bladder being arranged in said functional gap along a bottom edge of said shell structure adjacent said downward-facing opening;

said bladder and rigid dynamically responsive material defining a deformable member, said deformable member having a negative clearance with respect to said wearer's head, wherein during insertion of the wearer's head into said head gear, forces and vibration associated with said insertion cause said dynamically responsive material to become more fluid, thereby causing said dynamically responsive material within said bladder to deform, and following said insertion, said dynamically responsive material within said bladder returns to an original shape.

11. The head gear of claim 10, wherein said dynamically responsive material returns to a rigid state follow said temporary response.

12. The head gear of claim 11, wherein said head gear provides greater circumferential support following said forces and vibration associated with said insertion.

13. The head gear of claim 12, wherein said greater support causes said head gear to shift on said wearer's head less upon impact.

14. The head gear of claim 10, covering a greater circumference of the head of the wearer relative to prior art head gear, and further wherein said greater circumference includes covering a greater extent of the lower jaw of the wearer.

15. The head gear of claim 10, wherein said function gap furthermore defines a plurality of compartments arranged to create radially differentiated zones containing different materials therein to create radially differentiated properties, which causes said head gear to rotate upon impact.

16. A tight fitting comfortable head gear configured to fit a head of a wearer of the head gear, comprising:

a shell structure, wherein said shell structure further comprises a functional gap, with said functional gap arranged between an outer shell structure and inner shell structure, wherein said inner shell structure is arranged to engage the head of the wearer of the head gear, said shell structure defining at least a forward-facing opening and a downward-facing opening;

at least one bladder comprising at least one rigid dynamically responsive material, said bladder having a shell side and a wearer's side, said bladder being arranged in said functional gap;

said bladder and rigid dynamically responsive material defining a deformable member, said deformable member having a negative clearance with said wearer's head, wherein during insertion of the wearer's head into said head gear, forces and vibration associated with said insertion cause said deformable material to deform to permit full insertion of the head, and following said insertion, said deformable material assumes its original shape, said deformation and shape restoration thereby permitting said head gear to cover a greater circumference of the head of the wearer relative to prior art head gear, and further wherein said greater circumference includes covering a greater extent of the lower jaw of the wearer.

17. The head gear of claim 16, wherein said shell structure further comprises an impact measurement system.

18. The head gear of claim 17, wherein said impact measurement system comprises a pressure sensitive member.

19. The head gear of claim 18, wherein said pressure sensitive member is arranged to emit a perceptible signal.

20. The head gear of claim 19, wherein said perceptible signal is emitted when a predetermined force is encountered.

21. The head gear of claim 20, wherein said impact measurement system is disposed in said functional gap.

* * * * *